US005235127A

United States Patent [19]

Findley

[11] Patent Number: 5,235,127

[45] Date of Patent: Aug. 10, 1993

[54] WEAPON DISCHARGE SIMULATION SYSTEM AND ELECTROSTATICALLY DISCHARGED PYROTECHNIC CARTRIDGE FOR USE IN SAID SYSTEM

[76] Inventor: Stephan D. Findley, 710 Willow St., Marshall, Tex. 75670

[21] Appl. No.: 575,169

[22] Filed: Aug. 30, 1990

[51] Int. Cl.[5] ..... F42B 4/00

[52] U.S. Cl. ..... 102/200; 102/472

[58] Field of Search ..... 102/200, 206, 472; 42/84

[56] References Cited

U.S. PATENT DOCUMENTS

| | | | |
|---|---|---|---|
| 1,503,740 | 8/1924 | Adler | 102/335 |
| 2,072,621 | 3/1937 | Gagle | 42/84 |
| 2,548,946 | 4/1951 | Clauser et al. | 102/335 |
| 3,563,177 | 2/1971 | Ritchey | 102/472 |
| 3,712,230 | 1/1973 | Hoffmann | 102/206 |
| 3,722,418 | 3/1973 | Hoffmann | 102/206 |
| 4,217,717 | 8/1980 | Canty et al. | 102/200 |
| 4,325,304 | 4/1982 | Ormiston | 102/200 |
| 4,641,580 | 2/1987 | Ogatsu | 102/200 |

*Primary Examiner*—Charles T. Jordan

*Attorney, Agent, or Firm*—Sean Patrick Suiter; H. Robert Henderson; Michael O. Sturm

[57] ABSTRACT

A device for simulating weapons firing by igniting various signature cartridges both singularly and in multiple burst sequences. A electronic timing source which provides the necessary control and impulses to perform said ignition. A unique cartridge design which provides safe and reliable performance.

5 Claims, 3 Drawing Sheets

WEAPON DISCHARGE SIMULATION SYSTEM AND ELECTROSTATICALLY DISCHARGED PYROTECHNIC CARTRIDGE FOR USE IN SAID SYSTEM

BACKGROUND OF INVENTION

This invention relates to pyrotechnic devices and systems, and to their corresponding firing circuits. These devices, systems and circuits are more particularly, but not exclusively, suited for use in weapons simulation systems (i.e. they simulate the flash, bang, and smoke produced by the firing of a gun).

Past technologies for ignition of pyrotechnic compounds as utilized in simulator cartridges are of the nature as follows: electric squibs and percussion primers. Drawbacks to these types of systems, primarily the squib systems, are in the area of safety and cost of manufacturing. It is an object of this invention to provide a safer and less expensive means of igniting pyrotechnic compounds.

SUMMARY OF THE INVENTION

The Omega Simulator Systems are used in conjunction with Omega Simulator Cartridges to produce simulated signatures which can be utilized by organizations such as the Armed Forces during training exercises. This invention employs a multiple spark discharge (MSD) technique along with a unique, inexpensive cartridge design to ignite a pyrotechnic compounds. The Omega simulators are of a design which is extremely impervious to the environment (i.e. water, dirt, sand, mud, cold and hot temperatures). The basic design of the cartridge employs a female center electrode and a remote male electrode with a spark gap of approximately ⅛" to ¼" between the male and female electrodes. This spark gap is surrounded by the perspective pyrotechnic compound to be ignited upon command. The Omega simulator device applies a multiple spark across the electrodes thus igniting the pyrotechnic composition. This MSD can be varied in frequency and duration to allow variations of pyrotechnic compounds.

DESCRIPTION OF THE PREFERRED EMBODIMENT

Figure 1:
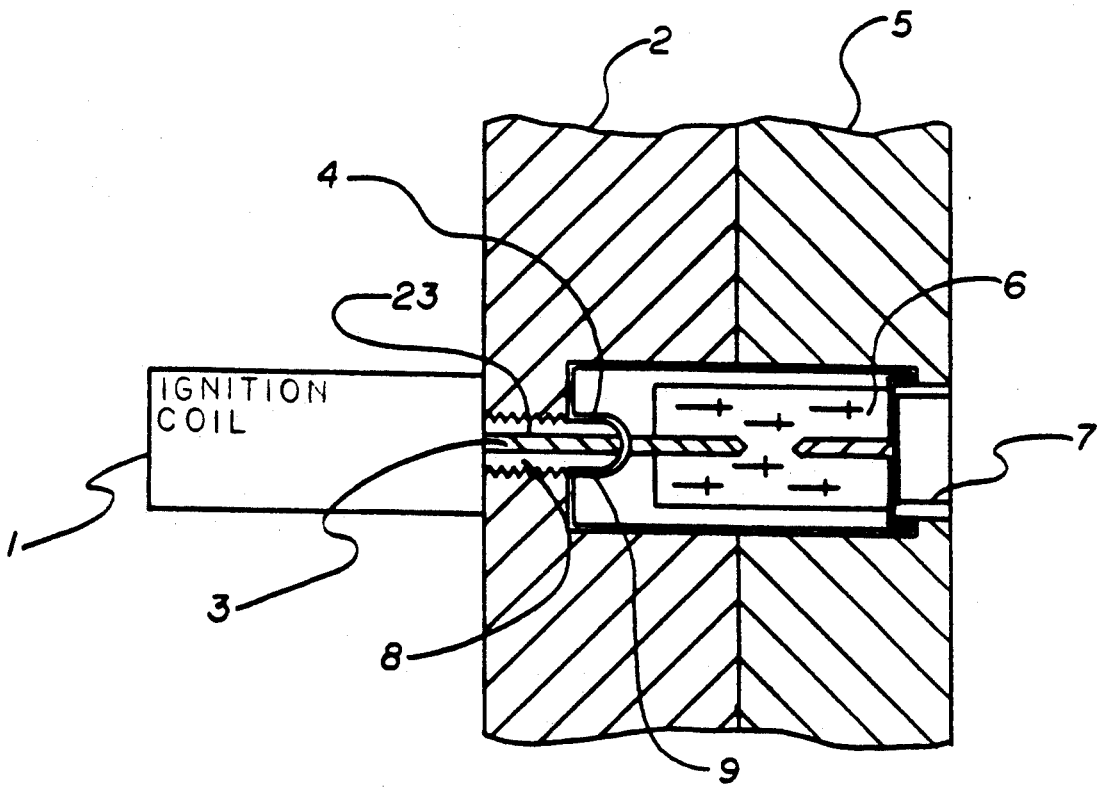
FIG. 1 is a typical firing position, illustrating the unique ignition technique to be used in this invention.
Figure 2:
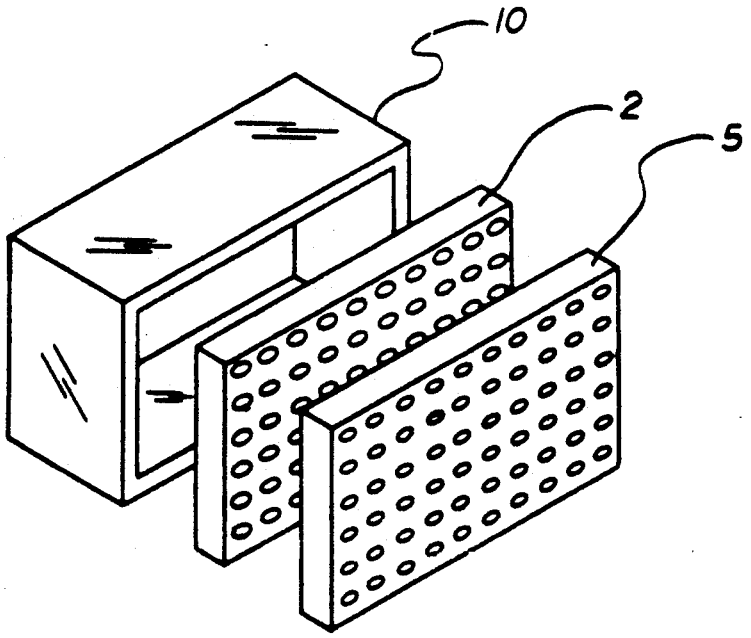
FIG. 2 is a perspective view of a possible configuration of this invention showing the external mechanical components and their relation to one another.

Referring now to the drawings, there is shown in FIGS. 1 and 2 an embodiment of the invention which will fire 60 total shots, including both a sequence of individual shots and sequences of shots in bursts. The shots generated are generally intended to simulate gunfire effects in military training exercises. It should be noted that the invention now being described, is by way of nonlimitative example only, and could be modified to tailor a particular need.

A major feature of this design is a miniature ignition coil 1 which has a male electrode tower 8 affixed to its top. Sixty of these assemblies are screwed into the base of a non-conductive plastic plate 2 providing one half of a chamber for sixty pyrotechnic cartridge shells 4 to be inserted. Each male electrode tower 8 has an o-ring 9 installed on its end which when socketed into the female section of a cartridge shell 4 creates an environment resistant seal.

The forward cartridge plate 5 is made from conductive metal and forms the front chamber section for each of the sixty cartridge positions. A typical cartridge which would be installed into each of the chambers consists of a plastic cartridge shell 4, a conductive plastic positive electrode 3, a conductive plastic negative electrode and lid 7, and a pyrotechnic composition 6. The lid 7 can be sealed to the cartridge shell 4 by an appropriate adhesive or by ultrasonic welding.

Figure 3:
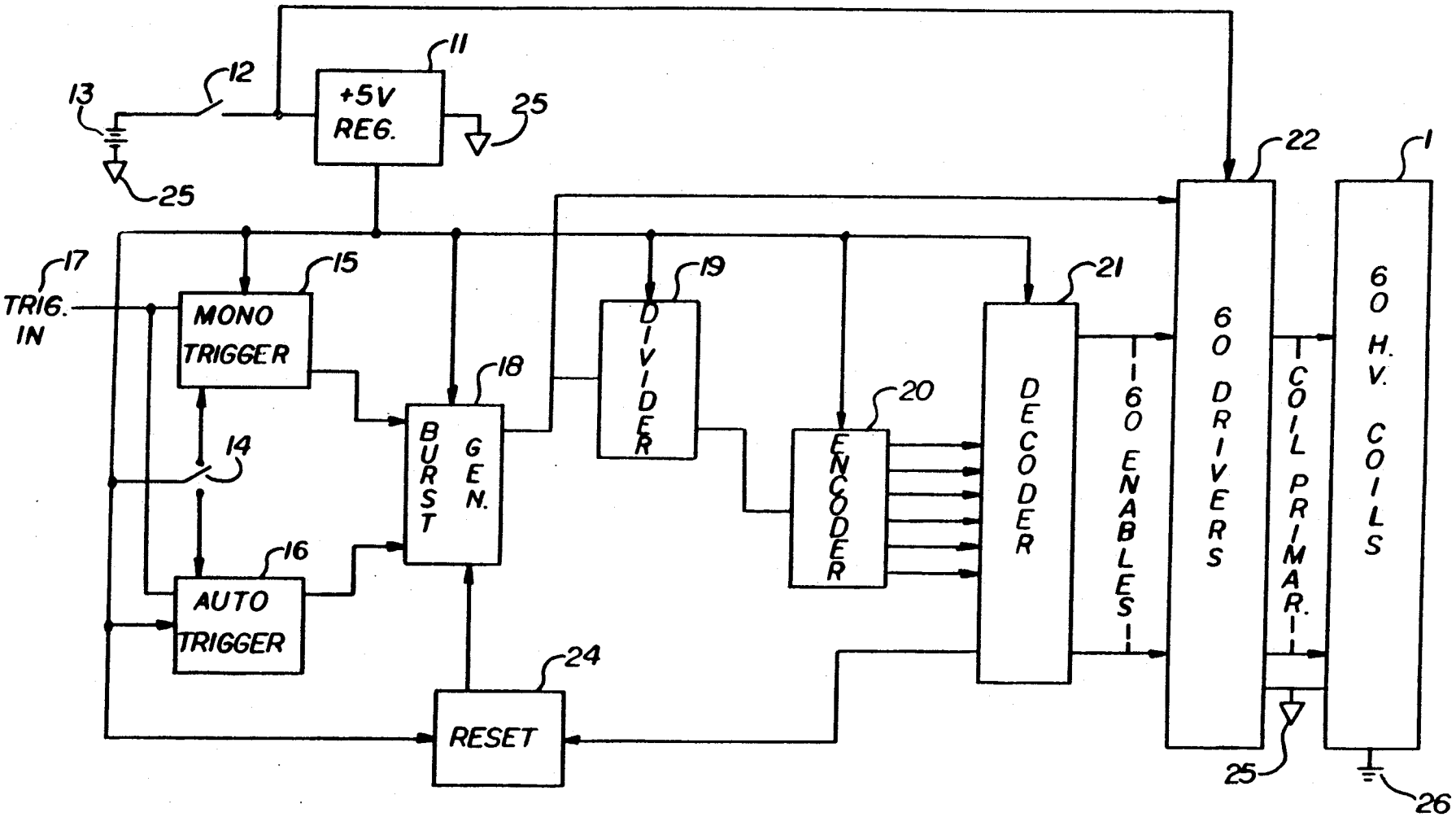
FIG. 3 is a block diagram of the circuitry for firing the embodiment shown in FIG. 2.
Figure 4:
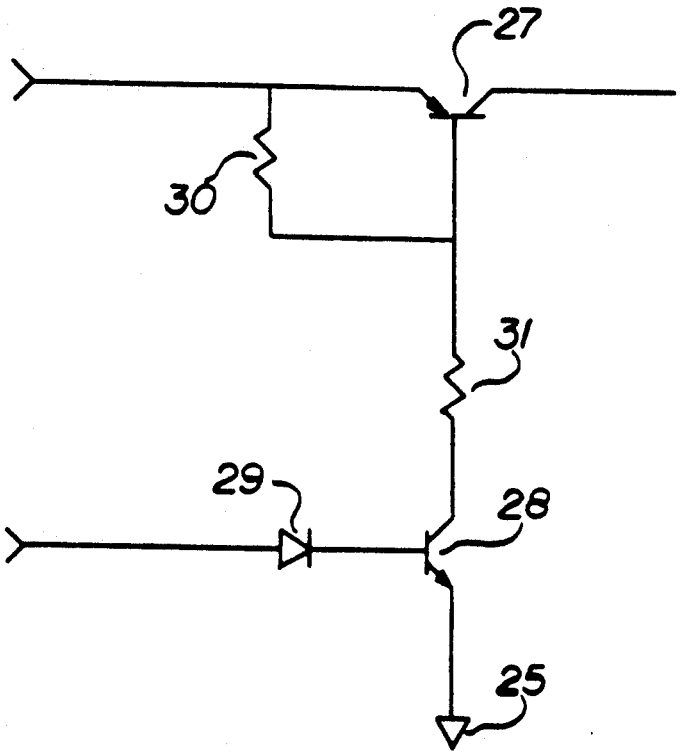
FIG. 4 is a diagram of one typical coil driver illustrating a possible technique of driving the high voltage coils.

The electronics such as shown in FIG. 3 and 4 energizes the ignition coil 1, which produces a train of high voltage sparks through the middle conductive rod 23, the male electrode tower 8, the positive electrode 3, across a spark gap to the negative electrode and lid 7, through the conductive front plate 5 and back to a common high voltage ground. The energy produced across the spark gap ignites the pyrotechnic composition thus producing a flash, bang, and smoke signature. This technique provides a safe and inexpensive method of producing and igniting pyrotechnic cartridges.

A block diagram is shown in FIG. 3 of the electronics necessary to energize the high voltage coils 1. The system is powered from a DC source 13 of 12 to 30 Volts with a preferred source of 24 DC. The system is powered on by switch 12 which in turn supplies power through a +5VDC Regulator 11 to all the logic blocks. The input voltage is also applied directly to the 60 drivers 22 for energizing the coils.

The electronics operates in one of two modes determined by the position of switch 14. When +5VDC is applied through switch 14 to the mono trigger block 15, the mono mode is selected and the "trigger in" 17 will be recognized by the mono trigger block. When +5VDC is applied through switch 14 to the auto trigger block 16, the burp mode is selected and the "trigger in" 17 will be recognized by the auto trigger block. The circuitry of blocks 15 and 16 may be adjusted to recognize various trigger level inputs.

The mono trigger block 15, when selected and a trigger is recognized, applies a single initialization pulse to the burst generator block 18. Block 18 when triggered outputs a single pulse train with a duration and frequency predetermined by hardware component selection. The output pulse train is applied both to the frequency divider block 19 and also to each of the sixty drivers 22.

Frequency divider block 19 generates a single clock pulse for each pulse train generated by the burst generator. The clock pulse drives an encoder block 20 which drives a decoder block 21. The combination of blocks 19, 20 and 21 sequence through and individually select one of the sixty positions. The selection of an output by the decoder block 21 allows the PWM signal from burst generator 18 to be used in conjunction with the Power In 13 to "fire" an ignition coil 1. At the end of the 60th shot the system deactivates itself via the reset block 24, and power must be cycled off and back on before the system will recognize any more trigger inputs.

The burp mode differs in operation from the mono mode only in the fact that the auto trigger block 16 is selected in place of the mono trigger block 15 and outputs a series of burst trigger pulses instead of a single pulse. The timing characteristics of these pulses are predetermined by hardware component selections.

There are two separate grounds in the system. Ground 25 is a low voltage and digital ground. Group 26 is a High voltage ground and is separate from the logic ground. It is electrically connected between the negative electrode of the cartridges and the secondary return side of the coils.

FIG. 4 shows a typical coil driver found in driver block 22. Transistor 27 is a high-current power transistor with the emitter connected directly to the power on-off switch 12. The collector is connected to one side of the primary winding of the ignition coil 1. Transistor 28 is a switching transistor driving the base of transistor 27. Resistors 30 and 31 provide the biasing for transistor 27. Diode 29 provides an output protection for preceding decoder block 21.

Because of the use of a high-voltage multiple spark for composition ignition, the basic technique of ignition may be modified for many types of cartridges (i.e. cartridge size, signature, etc.). "Remote" ignition can be accomplished through the use of "spark-plug" wires.

Alternative methods of electronic design, mechanical design and manufacturing may be utilized to tailor the system to a particular need and provide the most competitive price. It is to be understood that the invention may be practiced otherwise than as specifically described.

We claim:

1. An apparatus for simulating weapon firing, comprising:

a plurality of pyrotechnic cartridge shells having a female ignition cavity, a positive electrode, and a discharge end having a negative electrode;

a plurality of ignition coils having, a male electrode tower with an o-ring disposed on its end for removably sealing one of said male electrode towers in one of said female ignition cavities of said shells, and an electrode protruding from said tower and adapted to make electrical contact with said positive electrode of said pyrotechnic cartridge shell;

a pyrotechnic housing adapted to removably receive a plurality of pyrotechnic cartridge shells, said housing formed of;

a non-conductive base plate having a plurality of cavities wherein each cavity is adapted to removably receive an ignition coil and a portion of one of said pyrotechnic cartridge shells, and a conductive forward cartridge plate having a plurality of cavities wherein each cavity is adapted to removably receive the discharge end of one of said pyrotechnic charges; and a cartridge shell lid having a negative electrode for making electrical contact with said negative electrode of said shells whereby a potential difference applied across said conductive forward cartridge plate and said plurality of ignition coils will cause said cartridge to explode such that gun fire is simulated.

2. The apparatus of claim 1, further comprising timing means for selectively providing single or multiple bursts of electrical signals whereby said pyrotechnic cartridge shells may be fired in single or multiple burst modes.

3. The apparatus of claim 1, further comprising a case for housing said housing from extreme environmental conditions.

4. An pyrotechnic cartridge shell for simulating weapon fire and adapted to be ignited by an electrostatic spark, comprising:

a housing having a cavity adapted to removably receive an ignition post;

said housing containing a pyrotechnic composition;

a first electrode having a first electrode tip disposed within said housing and said pyrotechnic composition;

a second electrode having a second electrode tip disposed within said housing and said pyrotechnic composition;

means for transferring an electric current from said housing cavity through said first electrode such that said electric current jumps the gap between said first and second electrode tips igniting said pyrotechnic composition; and means for transferring an electric current from said housing through said second electrode such that said electric current jumps the gap between said first and second electrode tips igniting said pyrotechnic composition.

5. A method of simulating weapon fire, comprising:

providing at least two pyrotechnic cartridge shells for simulating weapon fire and adapted to be ignited by an electrostatic spark, said shells including:

a housing having a cavity adapted to removably receive an ignition post;

said housing containing a pyrotechnic composition;

a first electrode having a first electrode tip disposed within said housing and said pyrotechnic composition;

a second electrode having a second electrode tip disposed within said housing and said pyrotechnic composition;

means for transferring an electric current from said housing cavity through said first electrode such that said electric current jumps the gap between said first and second electrode tips igniting said pyrotechnic composition;

means for transferring an electric current from said housing through said second electrode such that said electric current jumps the gap between said first and second electrode tips igniting said pyrotechnic composition;

providing electrical current supply means having timing means for selectively providing single or multiple bursts of electrical current to said electrodes whereby said pyrotechnic cartridge shells may be fired in single or multiple burst modes; and electrifying said electrical current supply means whereby weapon firing may be simulated.

* * * * *